US006189584B1

(12) United States Patent
Cayce

(10) Patent No.: US 6,189,584 B1
(45) Date of Patent: Feb. 20, 2001

(54) DISPOSABLE CARBIDE BLADE ASSEMBLY FOR UNIVERSAL ROTARY CUTTER

(76) Inventor: Douglas Scott Cayce, 10638 Anglohill Rd., Cockeysville, MD (US) 21030

( * ) Notice: Under 35 U.S.C. 154(b), the term of this patent shall be extended for 0 days.

(21) Appl. No.: 09/372,497

(22) Filed: Aug. 11, 1999

Related U.S. Application Data

(60) Provisional application No. 60/096,224, filed on Aug. 12, 1998.

(51) Int. Cl.[7] ..... B27C 5/00

(52) U.S. Cl. ..... 144/230; 144/218; 144/229; 144/241; 407/34; 407/37; 407/40; 407/47; 407/49

(58) Field of Search ..... 144/218, 229, 144/230, 241; 407/33, 34, 36, 37, 38, 40, 47, 48, 49, 103, 104, 106, 107; 409/234, 241

(56) References Cited

U.S. PATENT DOCUMENTS

| | | | | |
|---|---|---|---|---|
| 1,621,226 | | 3/1927 | Welter . | |
| 1,762,111 | | 6/1930 | Weddell . | |
| 3,309,758 | | 3/1967 | Williams . | |
| 3,946,474 | | 3/1976 | Hahn et al. . | |
| 4,449,556 | * | 5/1984 | Colton | 144/230 |
| 4,658,875 | * | 4/1987 | Grabovac | 144/230 |
| 5,033,916 | | 7/1991 | Bunklau . | |
| 5,211,516 | | 5/1993 | Kress et al. . | |
| 5,536,119 | * | 7/1996 | Werner et al. | 407/42 |
| 5,658,101 | | 8/1997 | Hammer . | |
| 5,800,079 | * | 9/1998 | Qvarth | 407/49 |

* cited by examiner

*Primary Examiner*—W. Donald Bray
(74) *Attorney, Agent, or Firm*—Law Offices of Royal W. Craig

(57) ABSTRACT

A disposable carbide cutting blade assembly for a universal rotary molding cutter head. The assembly comprises a disposable carbide blade blank having its cutting surface contoured to the desired configuration, a smooth rear, bottom, and front surface, and a hole extending through the carbide blade blank. The carbide blank is positioned against a steel backer plate, which in turn is provided with a ledge for supporting the carbide blank from below, and a smooth front surface against which the rear surface of the carbide blank rests when in position. A safety pin protrudes from the front face of the steel backer plate, and extends into the hole within the carbide blank to properly seat the carbide blank against the steel backer plate. The rear surface of the steel backer plate is provided corrugations along its entire height for mating with the corrugations on the inner wall of a slot of a universal rotary cutter head. This simplified construction of the combined steel backer plate/carbide cutter blade assembly allows inexpensive carbide cutter blades with minimal machining to be used in universal cutting heads. This eliminates the need for costly and hazardous pre-machining or continuous sharpening of the cutting surface because the carbide blades can be easily replaced without incurring substantial expense.

8 Claims, 3 Drawing Sheets

DISPOSABLE CARBIDE BLADE ASSEMBLY FOR UNIVERSAL ROTARY CUTTER

CROSS-REFERENCE TO RELATED APPLICATIONS

The present application is based upon and gains priority from U.S. Provisional Patent Application Ser. No. 60/096,224, filed Aug. 12, 1998 by the inventor herein and entitled "DISPOSABLE CARBIDE BLADE ASSEMBLY FOR UNIVERSAL ROTARY CUTTER."

BACKGROUND OF THE INVENTION

1. Field of the Invention

The invention disclosed herein relates to a disposable carbide cutting blade assembly for a universal rotary cutting head. The assembly of the present invention comprises a disposable carbide blade blank having its cutting surface contoured to the desired configuration, a smooth front, rear, and bottom surface, and a hole extending through the carbide blade blank. The carbide blank is positioned against a steel backer plate, which in turn is provided with a ledge for supporting the carbide blank from below, and a smooth front surface against which the rear surface of the carbide blank rests when properly seated in position. A safety pin protrudes from the front face of the steel backer plate, and extends into the hole within the carbide blank to safely seat the carbide blank against the steel backer plate by eliminating the risk of the carbide blank being ejected from the cutting head during use. The rear surface of the steel backer plate is provided corrugations along its entire height for mating with the corrugations on the inner wall of a slot of a universal rotary cutter head.

2. Description of the Background

The woodworking industry makes use of numerous types of cutter assemblies. The precise contour of the final shaped piece determines the particular tool to be used. Wide varieties of tools have thus been developed, some of which are used for shaping artificial materials or particularly hard woods. The machining of such artificial materials or hard woods has traditionally required the use of very hard cutting tools. However, often such tools have been particularized to a single, specific function, making it a very expensive endeavor to attempt to produce a variety of shapes of hardwood or artificial wood products.

In order to shape artificial wood pieces and hard wood pieces, one such hard tool which woodworkers have used in the past include hard metal or carbide insert blades specifically contoured with the shape of the final piece to be produced. Often times, these carbide blades are held in rotary cutter head assemblies that are specifically dedicated for use with that carbide blade insert. The dedicated carbide insert heads have a circumference which is provided with an identical profile to the cutting profile of the carbide blade insert. Such identical profiling of the cutting head is required in order to fully support the very thin carbide insert, whose thickness is usually only 2 mm. Lacking such support, the thin carbide insert would break immediately upon impact with the surface to be shaped. Thus, the only known prior use of disposable carbide cutting inserts comprised delicately machined cutter heads that were specifically profiled for that one carbide blade insert. Obviously, such dedicated cutter heads required special machining, and resultantly were very expensive to use and to replace. Further, the option of producing a numerous variety of molding designs was vastly limited due to the cost of having a single dedicated cutting head for each desired profile.

One alternative to using such expensive, dedicated cutter head assemblies is to use a universal rotary cutter head, i.e., a head which can accept any self-supporting cutting blade assembly of any shape profile, such as a solid steel blade or a combination of a carbide blade with a steel backer assembly. Unfortunately, such systems require either sharpening or the expensive replacement of the blade after a short usage period. These carbide blade and steel backer assemblies have, in one embodiment, comprised a carbide insert which is brazed or soldered directly onto the steel backer, the combination then being profiled to the desired contour.

This brazed or soldered carbide cutting blade/steel backer plate assembly presents two problems. First, in order to provide the hardened carbide blade assembly with the desired cutting profile, a diamond grinding wheel must be used. As the hard carbide insert is profiled by the diamond grinding wheel, the softer steel backer plate is simultaneously abraded, often times loading up or fouling the abrasive texture of the diamond grinding wheel. Such fouling requires the machine operator to terminate the profiling process, clean the diamond grinding wheel of the excess scrap from the steel backer plate, replace the grinding wheel, and resume the profiling process. Such tedious steps dramatically slow the profiling process, and greatly adds to the cost of producing and replacing the brazed or soldered carbide cutting blade/steel backer plate configuration.

Further, the profiling process itself can be harmful to the carbide cutting blade insert. As the brazed or soldered combination is ground during the profiling process, a large amount of heat is generated which is disproportionately dispersed to the carbide and steel components. As the hard carbide insert heats, it becomes increasingly brittle, thus increasing the risk of fracture of the carbide insert during the profiling process, and in turn increasing the production and replacement cost of the assembly. Such expense prohibits these assemblies from affordably being classifiable as disposable components.

A second embodiment of previously known carbide blade and steel backer assemblies have utilized a carbide cutter plate which is held against a steel backer plate by means of a pressure block from the front and by means of a ridge on the steel backer plate mating with a longitudinal groove on the rear surface of the cutting plate to radially hold the cutting plate in place. The combined carbide cutter plate and steel backer plate could be moved radially to the outside of the cutter body, one corrugation at a time, such that the original cutting diameter could be maintained when the blades were sharpened. During the sharpening procedure, it was not necessary to grind the steel backer plate, such that the difficulties associated with the brazed/soldered embodiment in grinding the combination was overcome. However, this embodiment required the use of a dedicated cutter head to hold the assembly in place during use, and was therefore limited to only a few sharpening profiles. This limitation and the extreme cost associated with this configuration has prohibited its acceptance or wide spread usage in the woodworking industry.

Yet a third embodiment of previously known carbide blade and steel backer assemblies have comprised large carbide cutting blades provided with corrugations on one side for mating with the corrugations on the adjacent, front side of a steel backer plate. The rear side of the steel backer plate is likewise provided with corrugations for mating with the facing corrugations on the interior slot wall of a universal cutter head. Through such a corrugated assembly, the carbide cutting blade may be adjusted radially, while the steel backer plate is held in its original position. Thus, during the re-sharpening procedure, only the carbide blade need be sharpened. However, the initial machining of the carbide blanks to provide them with corrugations for mating with the steel backer is a hazardous and expensive endeavor. Namely, as the carbide blanks are machined with the corrugations, the material expelled comprises minute pieces of carbide which can be inhaled by a machine operator or which may become imbedded in the operator's skin, making such a machining process a significant health hazard. Further, when the carbide cutting blades are sharpened, material must always be removed from the blade surface, which in turn changes the cutter profile of the blade, regardless of the care taken by the machinist.

For example, U.S. Pat. No. 5,658,101 to Hammer describes a milling head having a series of slots for receiving a combination of a backing plate and blade plate, both the backing plate and the blade plate being provided with a series of interacting teeth and grooves which must be specially machined into the hard metal of the blade plate. As explained above, such machining imparts a significant cost to the individual blade plate making it economically infeasible to classify the blade plate as disposable. In fact, the system of Hammer '101 is particularly designed to enable a user to shift the blade plate radially outward for reshaping the blade plate, as the disposal of the specially machined blade plate after the dulling of the cutting surface caused by its initial use would be cost prohibitive. A dowel pin is also provided on the steel backer plate which engages an oblong slot on the blade plate to preclude an axial displacement of the blade plate. The oblong slot is particularly configured to allow and in fact encourage the radial displacement of the blade plate with respect to the support plate in order to allow the blade plate to be extended for sharpening and reuse. Thus, the dowel pin/slot arrangement has no effect on preventing the radial displacement of the blade plate during use, such that the system must rely on the interaction between the teeth on the backer plate and the specially machined grooves on the hard metal blade plate.

U.S. Pat. No. 5,211,516 to Kress et al. likewise describes a rotary boring tool having a reversible knife plate, the knife plate being equipped with a series of specially machined grooves which engage a series of mating teeth on a clamping shoe to form a positively locked connection between the knife plate and the clamping shoe.

U.S. Pat. No. 5,033,916 to Danklau describes a rotatable milling or drilling head holding a plurality of cutting inserts each provided with a series of specially machined indentations for receiving a clamping dog associated with the head which bears against the indentation to hold the cutting inserts in place during operation.

U.S. Pat. No. 3,946,474 to Hahn et al. describes a rotary cutting head having a series of bits helically arranged around the periphery of the cutting head. Each bit comprises a steel holder having a serrated back wall, and a cutting edge made of tungsten or carbide which is permanently affixed to the steel holder, such that replacement of the cutting edge requires replacement of the entire steel holder/cutting edge assembly.

U.S. Pat. No. 3,309,758 to Williams describes a rotary cutting tool having a bit backing optionally provided with serrations on its rear surface which engage complemental serrations on a recessed wall of the cutting tool. An optional eccentrically disposed pin extends from the front of the bit backing to engage a central opening in the cutting bit, the eccentric pin being flexed during installation of the cutting bit to hold the bit in place during use. Optionally, the pin may be eliminated and the cutting bit held against the bit backing using a wedge. Unfortunately, this assembly is entirely impractical for current high speed rotary hard wood shaping applications using a standard carbide cutting blade, as the minimal size of a standard carbide cutting blade requires that a back plate be particularly configured to embrace the entirety of the rear and bottom surfaces of the cutting bit, including providing the upper surface of the back plate with a contour that matches the top surface of the cutting bit, in order to prevent the carbide bit from splintering, cracking, or otherwise being damaged during use.

Each of the above-described embodiments require substantial machining to place the combined carbide cutting surface/backer plate assembly into an operative arrangement and to continue their use, including soldering, machining of grooves, sharpening, etc. Such machining processes provide for greater possibility of error in the fine machining of grooves and aligning of components for welding, and greatly increase the cost of these assemblies, likewise increasing the cost of their replacements and prohibiting them from taking on a disposable character.

It would therefore be advantageous to provide carbide cutting blades for use in a universal cutting head which could be produced at little expense, such that the carbide cutting blades could be used until dulled and then disposed of and readily replaced, while ensuring that the blades are securely fastened within the cutting head body.

SUMMARY OF THE INVENTION

It is, therefore, an object of the present invention to provide a disposable carbide cutting blade for a universal molding cutter head.

It is a further object of the present invention to provide a means for holding a disposable carbide cutting blade against a steel backer plate in a universal molding cutter head.

It is yet another object of the present invention to provide a non-corrugated, non-soldered cutter blade for use with a steel backer plate in a universal molding cutter head.

It is yet another object of the present invention to provide a mounting support for disposable, commercially readily available hard metal cutting blade blanks within a universal molding cutting head.

In accordance with the above objects, an improved profile cutting system for molding cutters is disclosed comprising economically disposable hard cutter (carbide) insert blades which are factory profile shaped with the desired cutting contour, and corrugated steel backer plates, the combination of the insert blades and the backer plates being configured to fit into the receiving slot of a universal molding cutter head. The hard metal cutting blades of the present invention require little machining, needing only to be shaped with the desired cutting profile, thus making the carbide blade economically disposable.

The hard metal cutting blade blank comprises a top face which defines a cutting surface contoured to the desired configuration, a smooth rear surface, a smooth front surface, and one or more holes extending through the carbide blade blank. The carbide blank is positioned against a steel backer plate, which in turn is provided with a ledge for supporting the carbide blank from below, and a smooth front surface against which the rear surface of the carbide blank rests when in position. One or more safety pins protrude from the front face of the steel backer plate, and extend into the holes within the carbide blank to prevent the blade from being axially or radially displaced. The rear surface of the steel backer is provided with corrugations along its entire height for mating with the corrugations on the inner wall of a slot of a universal rotary molding cutter head.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
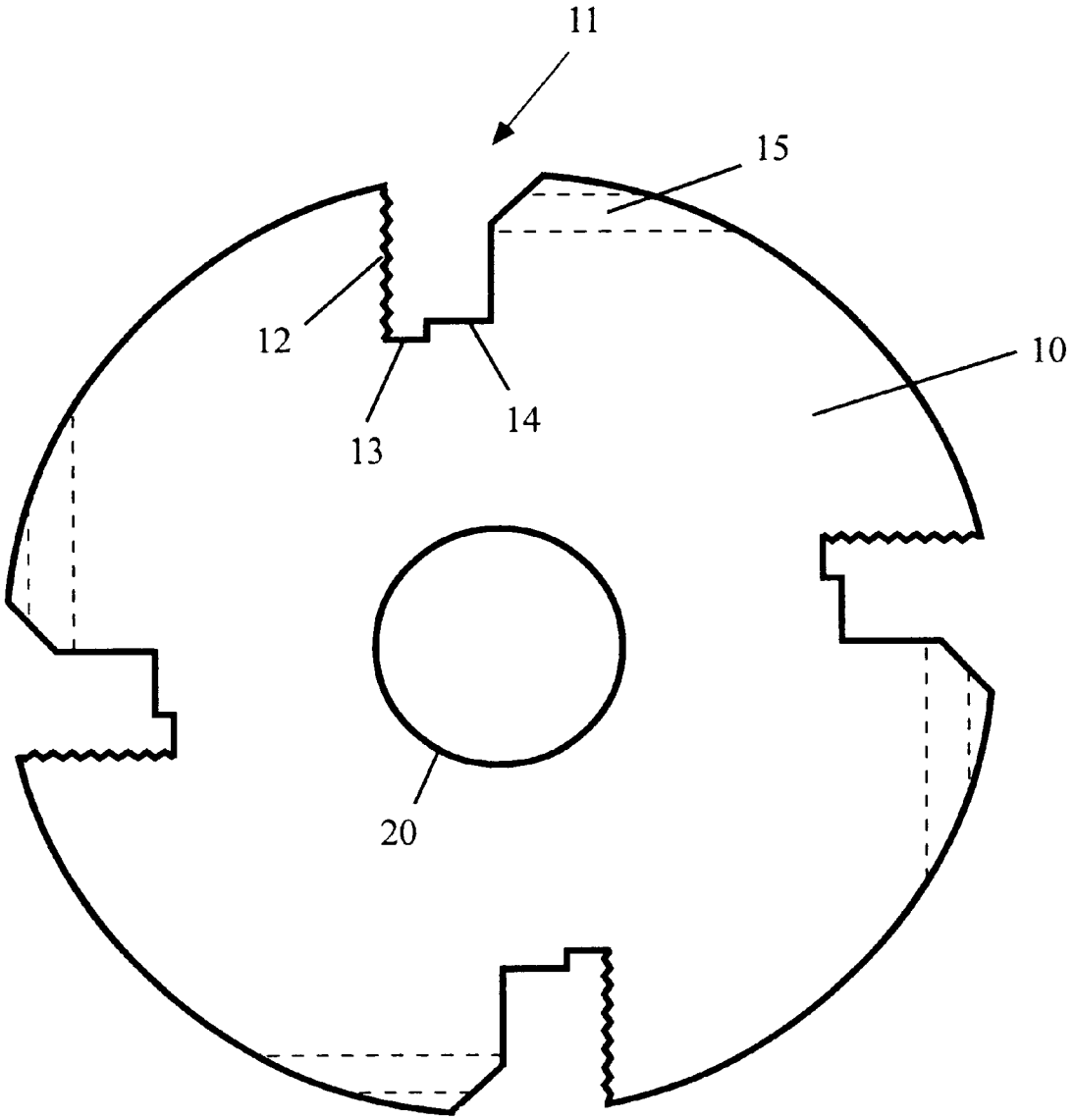
FIG. 1 is a side view of a universal molding cutter head assembly.

Shown in FIG. 1 is a side view of a standard universal rotary molding cutter head 10. Cutter head 10 is provided with a central bore hole 20 for attaching cutter head 10 to a rotary shaft. The cutter head is also provided with a series of circumferentially arranged slots, shown generally at 11, for receiving a cutting insert assembly (described further below). Each slot 11 is provided a corrugated back wall 12, a bottom plate receiving section 13, and a bottom spacer block receiving section 14. Corrugated back wall 12 is provided with a series of laterally extending teeth which extend the entire width of the slot opening (along the axial direction of the cutter head) and which run parallel to one another along the entire height of back wall 12.

An open threaded channel 15 is tangentially located adjacent to each slot. Threaded channels 15 are equipped to receive a threaded pin for holding a spacer block against a cutting surface, as described in greater detail below.

Such universal cutting heads have in the past been used for receiving a unitary high speed steel cutting knife having a corrugated back wall surface, or a composite hard metal or carbide cutting blade in combination with a steel backer block having corrugations on both sides of the block, one side engaging corresponding corrugations on the corrugated back wall 12 of the universal cutting head 10, the other side engaging at least one corrugation on the rear surface of the cutter blade to hold the cutter blade in place. The entire assembly would be moved radially outward and sharpened when necessary. While the present invention makes use of the same, well-known universal cutter head body, the specific insert assembly is used to mount a disposable carbide blade instead of the expensive corrugated face carbide blades previously known.

In order to truly classify a carbide cutting blade as disposable, it must be simple enough to manufacture that it can be sold for less than or equal to the cost of resharpening the traditional, expensive, non-disposable carbide cutter blades. Both disposable and non-disposable blades dull at the same rate, requiring either replacement or resharpening after the same amount of use. However, after a number of sharpenings the non-disposable blade must be replaced entirely, making the disposable cutter blades even more economical.

Carbide cutting blades in the past have either been soldered to the steel backer plate, their replacement requiring both a new blade and a new backer plate, or have been provided with corrugations for mating with facing corrugations on the steel backer plate, their replacement requiring the expensive and hazardous machining of fine grooves across an entire face of the carbide blade. However, the pre-soldered or pre-corrugated carbide cutting blade blanks are provided with smooth back, bottom, and front faces, the top face being sharpened to serve as the cutting surface. Such pre-machined carbide cutting blade blanks are commercially available from a number of sources, including, for example, Wisconsin Knife Works of Beloit, Wis. at a minimal expense. In fact, the cost of a soldered or machined carbide cutting insert is known in the woodworking machining industry to be roughly five to ten times the cost of the pre-machined carbide cutting blade blank.

Figure 2:
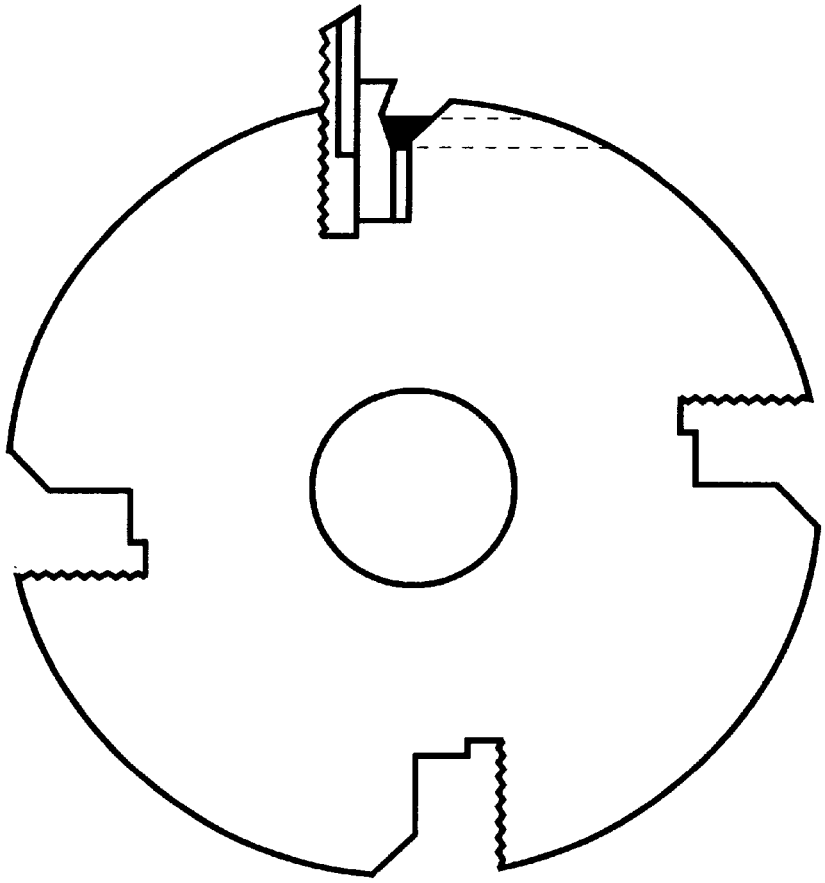
FIG. 2 is a side view of a universal molding cutter head assembly incorporating a disposable carbide cutter blade and steel backer assembly of the present invention.
Figure 2:
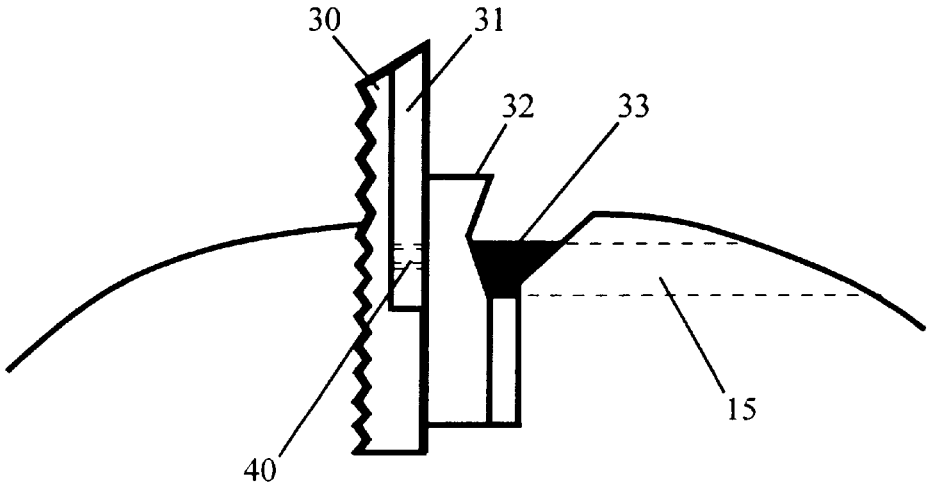

In order to securely mount a disposable, pre-machined carbide cutting blade within such a universal molding cutter head, and as shown in FIG. 2, received within slot 11 is a cutting assembly comprising a corrugated steel backer plate 30, a disposable carbide cutting blade 31, a pressure block 32 for holding the combined steel backer plate and carbide blade firmly in slot 11, and threaded pin 33 within threaded channel 15 for holding pressure block 32 against the steel backer plate and carbide blade.

Figure 3:
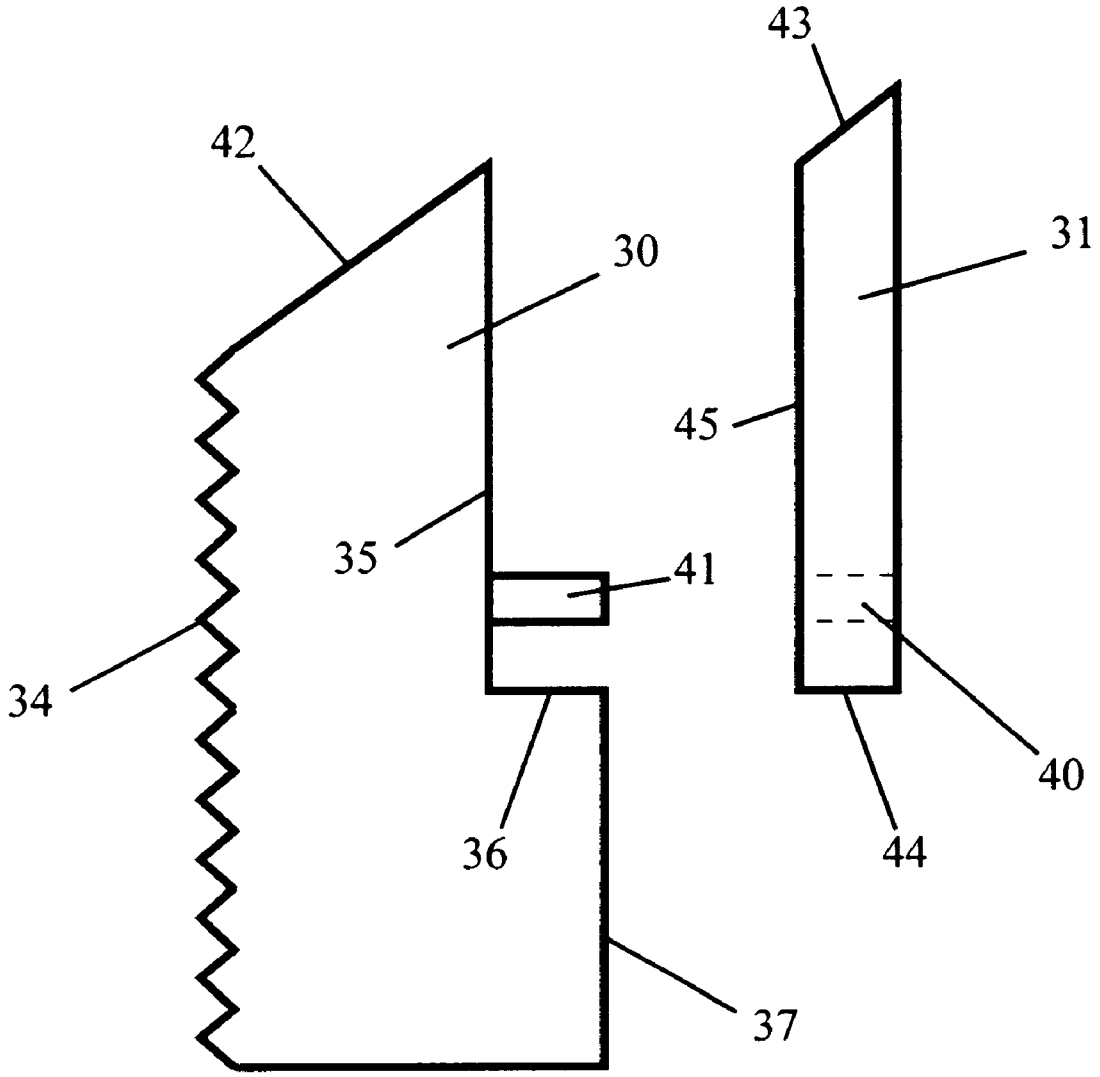
FIG. 3 is a close-up side view of the carbide cutter blade and steel backer plate of the present invention.

As shown in FIGS. 2 and 3, steel backer plate 30 is provided on its rear face with a series of corrugations 34. Corrugations 34 run across the entire width of the back face of steel backer plate 30, and run parallel to one another along the entire height of the back face of steel backer plate 30. Corrugations 34 are arranged to engage and mesh with facing corrugations on the back wall 12 of slot 11 on universal molding cutter head 10. The engagement of corrugations 34 with back wall 12 of slot 11 prevents steel backer plate 30 from being radially displaced with respect to cutter head 10 during operation.

On its front side, steel backer plate 30 is provided a smooth upper frontal face 35, a smooth lower frontal face 37, and a horizontal support ledge 36 therebetween. Protruding outwardly from upper frontal face 35, and tangentially with respect to cutter head 10, is a safety pin 41 for positioning a disposable carbide cutter insert.

The carbide blade blank is a unitary molded metal product, and is formed with one or two holes 40 extending therethrough during the molding process. Thus, the only machining that is required for the carbide blade blank is providing the blade with the desired cutting profile. Bore hole 40 is arranged within disposable carbide blade 31 such that when carbide blade 31 is positioned against steel backer plate 30, pin 41 on steel backer plate 30 extends through the bore hole 40 on disposable carbide blade 31, preventing carbide blade 31 from being radially and axially displaced from steel backer plate 30 during use. Carbide blade 31 rests against backer plate 30 such that the rear, smooth face 45 of carbide blade 31 abuts against the front, smooth face 35 of steel backer plate 30, the bottom, smooth face 44 of carbide blade 31 abuts against supporting ledge 36 of steel backer plate 30, and the top cutting edge 43 of carbide blade 31 is aligned with the top face 42 of steel backer plate 30 such that the top edges form a contiguous upper face for the composite steel backer plate/carbide blade insert assembly.

This cutting insert assembly prevents movement of the disposable carbide cutter blade 31 with respect to cutter head 10 in the following manner. The mating of corrugations 34 with the corrugated back wall 12 of slot 11 prevents radial displacement of steel backer plate 30 with respect to cutter head 10. Likewise, safety pin 41 prevents radial displacement of carbide cutter blade 31 with respect to steel backer plate 30 and thus with respect to cutter head 10. Because hole 40 is provided with the same contour of pin 41 such that pin 41 fits into hole 40 leaving minimal clearance, axial displacement of carbide cutter blade 31 with respect to steel backer plate 30 and cutter head 10 is likewise prohibited. Thus, both radial and axial displacement of disposable carbide cutter blade 31 with respect to steel backer plate 30 and cutter head 10 is prohibited without the need to braze or solder the carbide cutter blade to the steel backer plate, or to specially machine the carbide cutter blade and the steel backer plate with additional axial corrugations. Rather, the inexpensive, readily available carbide cutting blade blank may be provided having a single bore hole 40 molded therein for attachment to an insert assembly for use in a universal cutter head 10.

As shown in FIG. 2, in use, the disposable carbide cutter blade 10 is attached to steel backer plate 30 by inserting pin 41 into hole 40 on cutter blade 31 until the rear face 45 of cutter blade 31 abuts the smooth front face 35 of the steel backer plate. The steel backer plate/cutter blade assembly is inserted into slot 11 on universal cutter head 10 such that the corrugations 34 of steel backer plate 30 engage the corrugations on the rear wall 12 of slot 11. Finally, a spacer block 32 of conventional design is inserted into the remaining opening in slot 11. The rear face of spacer block 32 comprises a smooth vertical wall that abuts the front face of cutter blade 31 and the smooth lower frontal face 37 of steel backer plate 30, maintaining those faces in a common plane. The front face of spacer block 32 is likewise engaged by threaded pin 33, in turn clamping the combined steel backer plate/carbide cutter head assembly tightly between the rear wall 12 of slot 11 and spacer block 32. When the disposable carbide cutting insert becomes dull, it may simply be removed from the steel backer plate after disengaging spacer block 32 and replaced with a brand new disposable carbide cutter blade.

It may thus readily be seen that the present invention provides a unique mounting support assembly for holding a minimally-machined, and thus inexpensive and economically disposable, carbide cutter blade against a steel backer plate within the slot of a universal cutter head. Through this assembly, the operating expenses traditionally accompanying the use of carbide cutting surfaces are greatly reduced by providing easily replaceable surfaces.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. For use in a universal rotary molding cutter head having a series of slots located around a periphery of said cutter head, each said slot having a rear wall provided with a plurality of grooves. a disposable cutting assembly comprising:

a backer plate comprising a cutting blade support surface and a rear wall provided with a plurality of serrations configured to engage with said grooves on said rear wall of said cutter head, said cutting blade support surface including a smooth vertically disposed front face and a bottom support ledge, and a rigid pin outwardly extending from said vertically disposed front face above the bottom support ledge; and a disposable carbide cutting blade received on said cutting blade support surface, said cutting blade further comprising a smooth front surface, a smooth rear surface, a smooth bottom surface, and a cutting surface positioned at a top of said blade, and a through-bore from the front surface to the rear surface, said disposable carbide blade being seated on said cutting blade support surface such that the entirety of said rear surface of said blade is in facing contact with said vertically disposed front face of said support surface and the entirety of said bottom surface of said blade is in contact with said bottom support ledge, and the rigid pin outwardly extends through the through-bore in said carbide cutting blade;

wherein said blade is removably attached to said back plate.

2. The disposable cutting assembly of claim 2, said backer plate further comprising a top surface, said top surface of said back plate configured to lie in the same plane as said cutting surface of said blade.

3. A rotary molding cutter comprising:

a universal rotary molding cutter head, said molding cutter head further comprising a body defining a periphery, and a plurality of slots extending radially inward from said periphery, each said slot further comprising a rear wall, a bottom wall, and a front wall, and a plurality of grooves extending in an axial direction along said rear wall, a support plate, said support plate further comprising support means for supporting a cutting blade plate;

means for removably attaching a cutting blade plate to said support plate so as to prevent axial and radial movement of said blade plate with respect to said support means; and a disposable carbide cutting blade plate received on said support means, said cutting blade further comprising a smooth front surface, a smooth rear surface, a smooth bottom surface, and a cutting surface positioned at a top of said blade.

4. The rotary molding cutter of claim 3, said support plate further comprising:

a rear wall, said rear wall further comprising means for preventing movement of said support plate with respect to said molding cutter head.

5. The rotary molding cutter of claim 4, said means for preventing movement of said support plate with respect to said molding cutter head further comprising a plurality of serrations, said serrations being configured to engage with said grooves on said rear wall of said molding head.

6. The rotary molding cutter of claim 3, said means for removably attaching a cutting blade plate to said support plate further comprising:

a rigid pin extending from said support means on said support plate; and at least one opening extending into said blade, said pin being received in said opening to prevent axial and radial movement of said blade with respect to said support surface.

7. The rotary molding cutter of claim 3, said support plate further comprising:

a top surface, said top surface of said support plate lying in the same plane as said cutting surface of said blade.

8. The rotary molding cutter of claim 3, further comprising:

a pressure block positioned within each said slot of said molding cutter head;

a screw engaging a threaded bore hole in said cutter head body, each said bore hole penetrating said front wall of each said slot and said periphery of said cutter head body, said screw engaging said pressure block to cause said pressure block to impart tensile support against said blade and said support plate to prevent tangential displacement of said blade with respect to said support plate.

* * * * *